United States Patent [19]

Cornell

[11] Patent Number: 4,856,252

[45] Date of Patent: Aug. 15, 1989

[54] JOIST HANGER

[76] Inventor: James C. Cornell, 9501 S. Nogales Ave., Jenks, Okla. 74037

[21] Appl. No.: 288,436

[22] Filed: Dec. 22, 1988

[51] Int. Cl.[4] ..... E04B 1/38

[52] U.S. Cl. ..... 52/702; 249/219.1; 249/211; 249/23; 403/232.1; 52/632

[58] Field of Search ..... 249/23, 211, 219.1; 403/232.1, 353; 52/632, 702

[56] References Cited

U.S. PATENT DOCUMENTS

| | | | |
|---|---|---|---|
| 1,728,981 | 9/1929 | Ropp | 52/702 |
| 2,167,413 | 7/1939 | Bartlett | 249/23 |
| 2,495,408 | 1/1950 | Christoffersen | 52/702 |
| 4,342,440 | 8/1982 | Eyden | 249/219.1 X |

FOREIGN PATENT DOCUMENTS

| | | | |
|---|---|---|---|
| 1559052 | 2/1969 | Fed. Rep. of Germany | 249/23 |

*Primary Examiner*—David A. Scherbel

*Assistant Examiner*—Jerrold D. Johnson

*Attorney, Agent, or Firm*—Head & Johnson

[57] ABSTRACT

A hanger is disclosed for supporting a spanner beam or the like used in the construction of concrete platforms. The hanger can be a unitary device and comprise a pair of parallel side members, a top joist support interconnecting the side plates, an extension member projecting forward of the front edge of said side members, a bottom joist support member extending from one side member to the other, and a pivot means extending across the front of said side members. The front edge of each side member inclines rearwardly from top to bottom, and the pivot means is positioned so as to assure that the hanger is plumb when supporting a joist. The location of the pivot means also serves as a fulcrum point allowing the hanger to be removed after the platform construction is completed by means of a well-placed blow to the lower portion of the back of the hanger.

20 Claims, 3 Drawing Sheets

JOIST HANGER

FIELD OF THE INVENTION

The present invention relates to a supporting device. In another aspect, the present invention relates to a reusable joist hanger device useful for temporarily supporting a joist of a spanner beam or the like during the construction of bridge decks, elevated floors, or other elevated concrete slabs.

This application further relates to the applicant's Disclosure Document No. 210057, the disclosure of which is incorporated herein by reference.

BACKGROUND OF THE INVENTION

It is common practice to form concrete slabs over spaced apart beams or walls. The forms normally used in such construction projects to support the concrete while it hardens include wooden spanner beams supporting plywood panels. The spanner beams are suspended on hangers between the main structural girders or walls and the plywood panels are installed on top of the spanner beams to provide a flat surface for receiving the concrete. After the concrete has hardened sufficiently to become self-supporting, the forms are generally disassembled and removed for further use.

The types of hangers currently used to support the spanner beams suffer from various disadvantages, such as structural weakness, high cost, and assembly and disassembly difficulties. Also, since most existing hangers receive the spanner beam relatively loosely, the assembled forms lack rigidity and are able to shift in position or even collapse when the concrete is poured. Known hangers are further unsatisfactory in that the disassembly and removal of the forms require considerable time and effort and often result in damage to the forms or the hangers. More importantly, the disassembly or "wrecking" of the forms involves danger to the workmen because the spanner beams and plywood panels are released together and the entire bulk of the forms, therefore, must be handled simultaneously.

Another disadvantage of many of the prior art joist hangers is that they are constructed of a number of parts, many of which can be misplaced or lost by workmen prior to or after use. Further, many of the prior art joist hangers are constructed of materials which are subject to being ruined by being bent or fractured while being disassembled or transported between various construction sites.

In view of the foregoing drawbacks associated with existing joist hangers, an object of the present invention is to provide an improved hanger assembly.

More specifically, it is an object of the invention to provide a joist hanger assembly which supports a spanner beam in a rigid position between a pair of spaced girders or concrete block walls.

Another object of the present invention is to provide a joist hanger which is capable of tightly retaining the joist between the spanner beams or walls and yet which can be readily removed when disassembly is desired.

Another object of the invention is to provide a joist hanger which permits the assembly and disassembly of the forms to be carried out quickly, easily, and safely.

Yet another object of the present invention is to provide a joist hanger that is economically manufactured and yet constructed ruggedly for repeated use.

Still another object is to provide a joist hanger which can be a unitary sturdy article eliminating the possibility of lost hanger portions during disassembly and transportation.

Other objects, aspects, and advantages of the present invention will become apparent to those skilled in the art, having had the benefit of this disclosure and its accompanying drawings.

SUMMARY OF THE INVENTION

Figure 1:
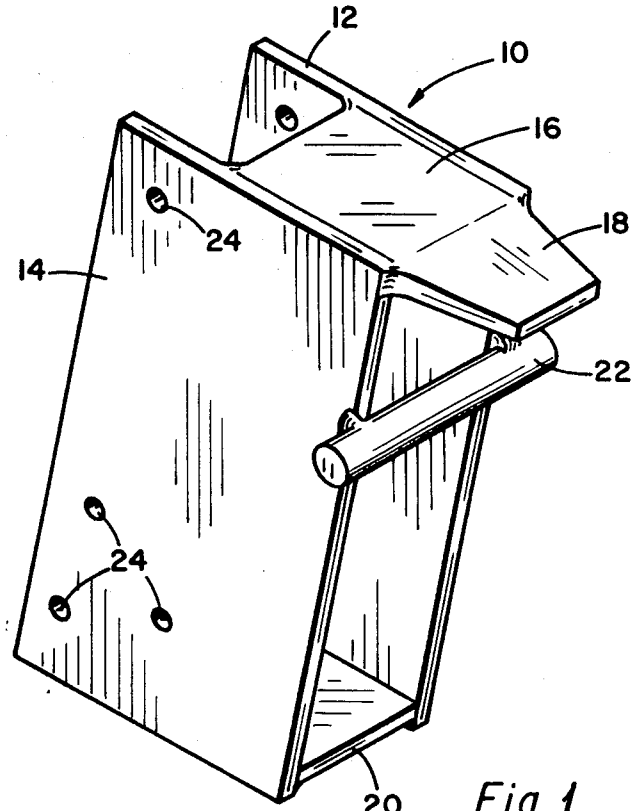
FIG. 1 is a perspective view from one side, from the front, and from above, of a preferred embodiment of a joist hanger constructed in accordance with the present invention.

In accordance with the present invention, there is provided a joist hanger capable of suspending a joist from an adjacent support surface. The joist hanger comprises a pair of parallel side members spaced apart sufficiently to receive a joist member, a top joist support member interconnecting the side plates, a bottom joist support member capable of supporting a joist member, and an extension member projecting outwardly from the front of the hanger a sufficient distance to enable said extension member to be rested upon a support surface. The front of the side members of the hanger incline rearwardly from top to bottom so that the angle between the top edge and the front edge of the side members is an acute angle. A pivot means extends across the front of the two side members at a point such that the front side of said pivot means is tangent to an imaginary plane that passes through said extension member and is perpendicular to the bottom of said extension member.

The top support member of the hanger is dimensioned such that the hanger can be pivoted downwardly even when containing a joist.

DETAILED DESCRIPTION

The pair of parallel side members of the inventive joist hanger can be constructed of any suitable material. In a preferred embodiment, the side members are steel plates. The thickness of such plates can vary depending on the stress to which the joist hanger will be exposed. Generally the side plates would be constructed of plates having a thickness in the range of $\frac{1}{8}$ to $\frac{1}{2}$ inch, more preferably, about $\frac{1}{8}$ to about $\frac{1}{4}$ inch. The edge of the side member that will form the top of the joist hanger is a generally straight edge. The side of the side member that is to form the front of the joist hanger inclines rearwardly from the top to the bottom such that the angle between the top edge and the front edge of the side member is an acute angle. Typically, this acute angle would be in the range of about 60° to 85°, more preferably about 75° to 85°. In a particularly preferred embodiment, the side members are formed from parallelogram plates in which both the front and rear side edges of the plates incline rearwardly from top to bottom of the plates. It is, however, within the scope of the present invention to employ plates in which the edge which is to the rear of the joist hanger could have any suitable geometric shape.

The top support member of the inventive joist hanger can likewise be constructed of any suitable material. A purpose of the top member is to interconnect the side plates so that they will be spaced apart sufficiently to receive a joist member. Typically, this spacing is such that a joist member can be positioned between the plates but with little room for play. Typically, the plates would be spaced apart by about 1 to about 2 inches, more preferably, about 1¾ inches. The top support member could take the form of two or more rods extending from one plate to the other or of a plate of sheet metal. The top support member also can provide a top surface which can, if desired, bear upon the top of a joist placed within the joist hanger. The currently preferred embodiment employs a top joist support member that is a plate of metal. The thickness of the plate would preferably be in the range of about ¼ to about ⅛ inch, more preferably about 5/16 inch.

The bottom joist support member can likewise take any suitable form. The purpose of the bottom joist support member is to provide support for the bottom of a joist that has been placed between the parallel side members. The bottom joist support member thus could include one or more rods extending from one of the side members to the other. A more preferred embodiment involves the employment of a plate of metal which extends from one side member to the other and is welded to the side members in a secured fashion. The thickness of the plate would generally be in the range of about ⅛ inch to about ¼ inch, more generally about 5/16 inch. It is also within the scope of the present invention to form the side members and the bottom joist support out of a single sheet of metal which is bent to form a structure in which the two side plates are perpendicular to the bottom plate.

The extension member can likewise take any suitable form. It is located so that it projects outwardly from the front of the hanger a sufficient distance to enable the extension member to rest upon a support surface. Most preferably, the extension member lies in a plane co-planar with the top edge of the side members. In the currently most preferred embodiment, the extension member is an extension of a top support member which comprises a single sheet of steel plate. In the most preferred embodiment the upper surface of the extension member is beveled downwardly from back to front and its sides incline inwardly from back to front.

The pivot means which extends across the front edge of the joist can take any suitable form. Most preferably, it is constructed of a material having a curved surface which will bear upon the wall or beam from which the hanger will be supported. Most preferably the pivot means is constructed of a solid rod or a sturdy solid round piece of tubing.

The joist hanger is preferably painted or galvanized to extend the length of its useful life.

Figure 2:
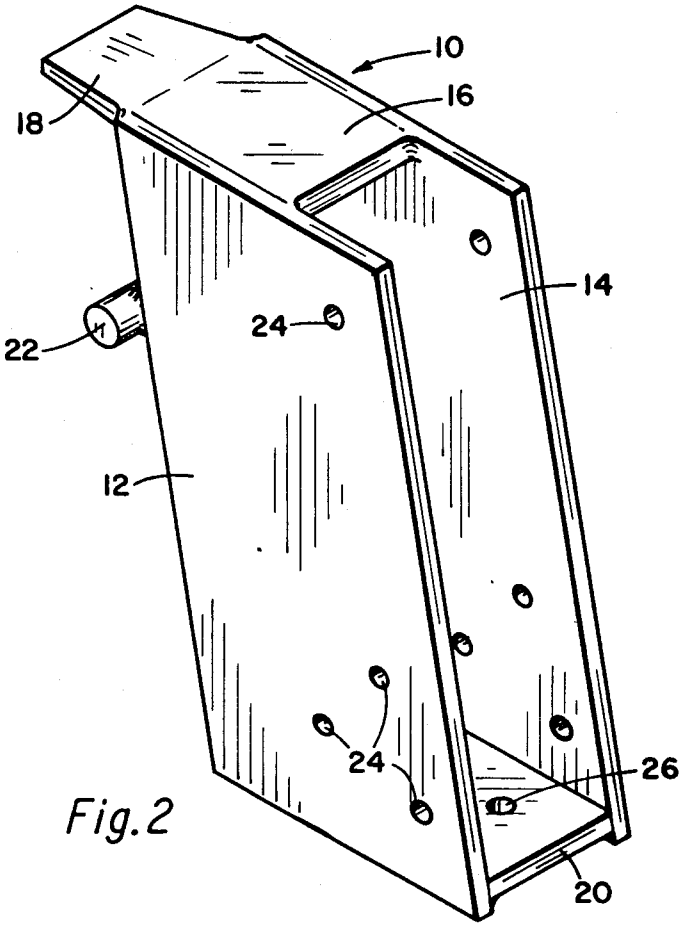
FIG. 2 is a perspective view of the hanger of FIG. 1 but from the other side, from the rear, and from above.

An example of a preferred embodiment of the present invention is disclosed in FIGS. 1 and 2. This particular joist hanger is generally designated by reference numeral 10. The joist hanger includes a pair of parallel side plates 12 and 14 spaced apart sufficiently to receive a joist member. Typically, the spacing would be such as to receive a standard 2×8 inch board. The side plates are connected by a top plate comprising a top support structure section 16 and an extension member section 18. The top support structure 16 covers only about half of the upper edge of the side plates. The extension member 18 projects outwardly from the front of the hanger. In this embodiment a bottom joist support means comprises a plate 20 welded to a lower portion of the side plates. Across the front of the hanger there is welded a section of solid round rod 22 which acts as a pivot point. A plurality of openings 24 extend through both side plates. The openings of the side plates are preferably in alignment as shown. An opening 26 also extends through the bottom plate.

In a particularly preferred embodiment of a joist hanger of the type illustrated in FIGS. 1 and 2, the side plates 12 and 14 are steel parallelogram plates about ⅛ inch thick wherein the horizontal distance between the front and rear edges of the plates is about 4 inches and where the vertical distance between the top and the bottom edges of the plates is about 7¾ to 8 inches. The top joist support member 16 and the extension 18 are formed from a single plate of steel having a length of about 3½ inches. This plate is welded to the side plates so that it is co-planar with the top edge of the side plates and so that about 1½ inches of the plate extends beyond the front edge of the side plate to provide the extension 18. The top joist support portion of the plate is about 5/16 inch thick and about 1¾ inches wide. The extension member portion gradually tapers from about 5/16 inch thick to about 5/32 inch thick. The sides of the extension member taper gradually inwardly about ¼ inch over the 1½ inch length of the extension member. The bottom joist support member is a 1¾ inch by 4 inch steel plate about ⅛ inch thick. The bottom plate is welded to each of the side plates so that when a standard 2×8 board is placed on edge between the side plates and on bottom plate, the top of the board will be co-planar with the top of the side plates. An opening for a nail most preferably extends through the bottom plate about ½ inch from the back edge of a plate.

The pivot means is a ½ inch diameter steel rod welded in place across the front edge of the two side plates about 2½ inches below the extension member of the top plate.

The strength of such devices will depend somewhat upon the materials employed and the welding used. Such a device can, however, be readily made so that it is capable of supporting 14,000 to 18,000 pounds, an amount well beyond the forces to which such joist supports would normally be exposed.

Figure 3:
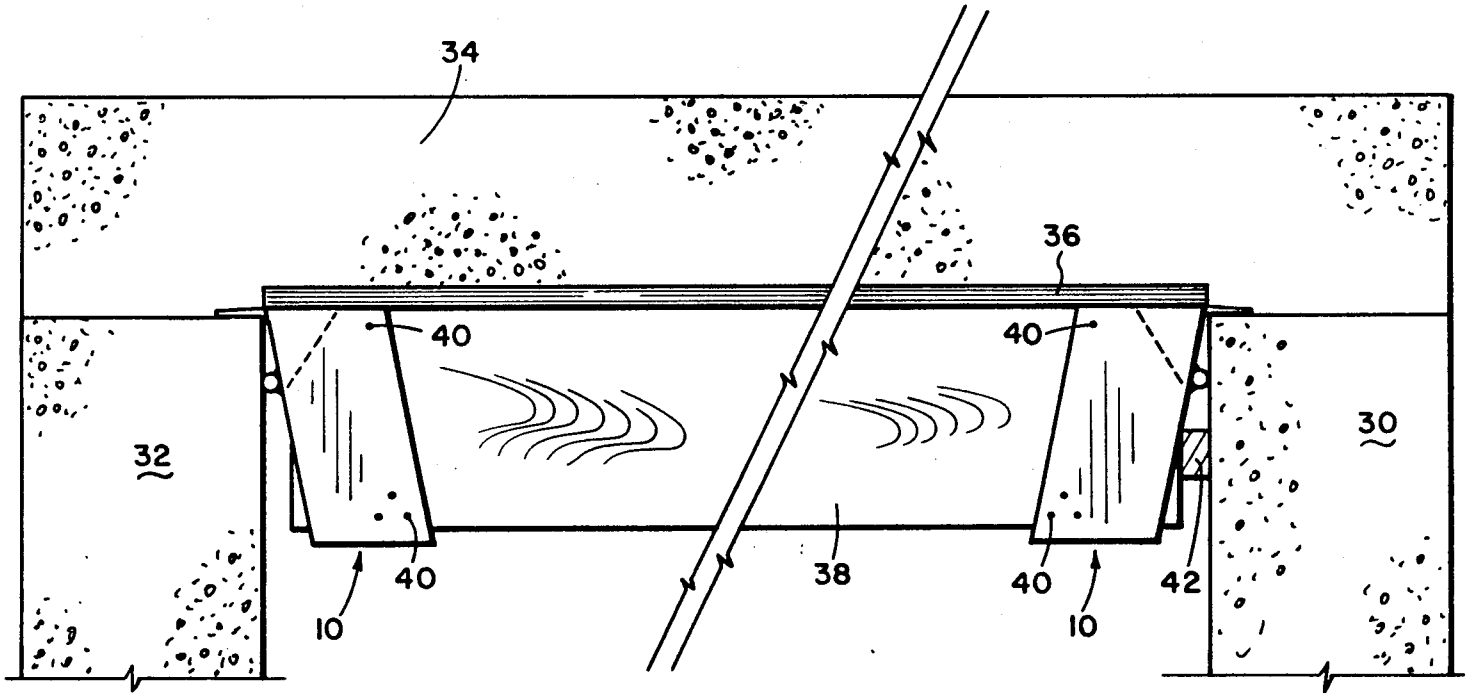
FIG. 3 is a side view of a joist supported between a pair of joist hangers of the type shown in FIGS. 1 and 2.

FIG. 3 demonstrates how the hanger of FIGS. 1 and 2 can be employed in the pouring of a concrete platform 34 over two spaced apart walls 30 and 32. Joist hangers 10 are positioned adjacent the opposite sidewalls such that the extension member of the joist hanger rests upon the upper surface of the respective wall. A suitably sized joist 38 is then placed within opposed joist hangers 10. The currently most preferred technique employs joists which each comprises two lengths of suitable lumber which are overlapped and nailed together. A support brace may be placed beneath the area of overlap of the joist boards. Typically, the material for joists includes pine, oak, and cottonwood. In an especially preferred embodiment, nails 40 are driven into the joists through the holes in the side plates. Generally, the nails are left extending outwardly somewhat from the sides of the joist hanger so that the nails can be readily removed when disassembly is desired. Nails can also be driven into the joists through the hole 26 in the bottom joist support member as shown in FIG. 1. It is generally preferred to employ joists which have a portion of the end cut off at an angle as illustrated by dotted lines in FIG. 3. Alternatively, we can merely butt a joist up against the back of the top support member so that the joist does not extend inside the hanger beyond that point.

Another option of the use of the inventive joist hanger is to position a 2×4 block of wood 42, or the like, between the front of the joist hanger 10 and the wall to further ensure that the joist hanger will remain stationary until disassembly is desired.

After a series of joists and joist hangers have been assembled as shown, sheets of plywood 36 are laid upon the joists, and the concrete platform is poured. After the concrete has hardened, the forms can then be disassembled. If a block of wood 42 has been employed as illustrated in FIG. 3, this block would first have to be removed by hitting with a hammer or with a hammer and chisel. After the nails 40 are removed, a lower back portion of the joist hanger can be hit with a hammer or mallet to cause the hanger to pivot about the pivot means. The extension means of the hanger will then slide free of the newly formed concrete platform. At this point the joists can be removed from the joist hanger and saved for later use. Finally, then, the joist hanger and the plywood sheets are recovered for later reuse.

Figure 4:
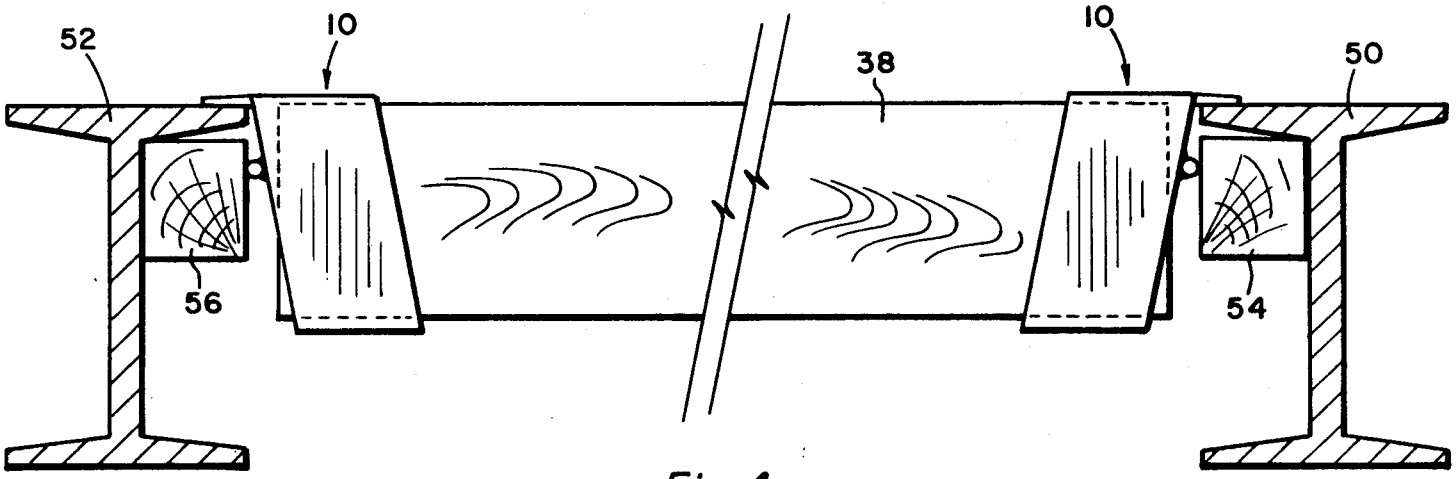
FIG. 4 is a side view illustrating how joist hangers of the type shown in FIG. 1 can be used to support a joist between a pair of I-beams.

FIG. 4 illustrates how the inventive joist hanger can be employed to support joists between the girders 50 and 52. In this particular use, suitably sized blocks 54 and 56 are secured in place to give the pivot means a surface to rest against which will keep the top of the joist hanger 10 level. As before, the joist is inserted into opposed joist hangers. Here again, if desired, one could also wedge blocks of wood between the front of the hanger and the respective block 54 or 56.

While the illustrations show the use of joists which fill the hangers, such hangers can also be used with narrower joists, for example, 2×6's or even 2×4's, if safety permits. To use the hanger with joists of narrower width, one merely has to insert on the top of the bottom plate inside the hanger a block suitably sized to take up the difference in dimension.

While the present invention has now been described broadly and illustrated by certain specific preferred embodiments, it should be clear that various modifications and variations can be made without departing from the spirit and scope of the present invention.

What is claimed is:

1. A joist hanger capable of suspending a joist from an adjacent support surface, said joist hanger comprising a pair of parallel side members spaced apart sufficiently to receive a joist, each said side member having a front edge which inclines rearwardly from top to bottom and having a top edge such that the angle between said top edge and said front edge is acute, a top joist support member interconnecting said side members so as to overlay a joist received in said hanger, said top joist support member having dimensions such as to allow said hanger to be pivoted downwardly even when a joist is located therein, an extension member projecting outwardly from the front of said hanger a sufficient distance to enable said extension member to be rested upon said support surface, a bottom joist support member extending from one of said side members to the other of said side members so as to be capable of supporting a joist between said side members, and a pivot means extending across said front edges of said side members at a point below said extension member, said pivot means having a protruding front portion which extends at least to an imaginary plane that passes through said extension member and is perpendicular thereto.

2. A joist hanger according to claim 1 wherein each said parallel side member comprises a solid metal plate having a straight top edge.

3. A joist hanger according to claim 2, said top joist support member being perpendicular to said side plates and having a top surface in the same plane as said top edges of said side plates.

4. A joist hanger according to claim 3, each said side member having a straight bottom edge parallel to its top edge.

5. A joist hanger according to claim 2 wherein said bottom joist support member is a metal plate secured perpendicular to said side plates.

6. A joist hanger according to claim 1 wherein said extension member is a continuation of said top support member.

7. A joist hanger according to claim 4 wherein the top surface of said extension member inclines downwardly away from the top joist support member.

8. A joist hanger according to claim 7 wherein said top joist member and said extension member consist of a single metal plate.

9. A joist hanger according to claim 1 wherein said pivot means has a generally circular cross-section.

10. A joist hanger capable of suspending a joist from an adjacent surface, said joist hanger comprising a pair of parallel side members spaced apart sufficiently to receive a joist therebetween, each said side member having a straight front edge which inclines rearwardly from top to bottom and having a straight top edge such that the angle between said top edge and said front edge is acute, a top joist support member perpendicular to and interconnecting a forward portion of the top edges of said side members such as to allow said hanger to be pivoted downwardly even when a joist is located in said hanger, an extension integrally forwardly projecting and inwardly tapering from said top joist support member, said extension having a top surface sloped downwardly to its free end, a bottom joist support member parallel to said top joist support member and interconnecting the lower portion of said side members so as to be capable of supporting a joist between said side members, and a pivot means extending across said front edges of said side members at a point below said extension, said pivot means having a protruding front portion which extends at least to an imaginary plane perpendicular to and passing through said extension.

11. A joist hanger according to claim 10 wherein said side members are parallelograms.

12. A joist hanger according to claim 11 wherein said acute angle is about 80°.

13. A joist hanger according to claim 12, said top support member having a top surface and said bottom support member having a top surface spaced at a distance of about 7 to 7¾ inches.

14. A joist hanger according to claim 13, the height of said side members being about 8 inches, the length of said side members being about 4 inches, the length of said extension being about 1½ inches, the length of said top joist support member being about 2 inches and said pivot means being a solid rod about ½ inch in diameter.

15. A joist hanger according to claim 14 wherein said side members are about ⅛ inch thick, said top joist support member is about 5/16 inch thick, said extension tapers downwardly from about 5/16 to about 5/32 inch, and wherein said bottom joist support member is about ⅛ inch thick.

16. A joist hanger according to claim 12 wherein said length of the top edges of said side plates is about 4 inches.

17. A joist hanger according to claim 12, said extension projecting about 1½ inches beyond the intersection of said front and top edge of said side plates.

18. A joist hanger according to claim 12 wherein said top joist support member extends rearwardly from the intersection of said front and top edges of said side plates about 2 inches.

19. A joist hanger according to claim 12 wherein said pivot means is a solid rod about ½ inch in diameter.

20. A joist hanger according to claim 12, the height of said side members being about 8 inches.

* * * * *